US005384343A

United States Patent [19]

Farrar et al.

[11] Patent Number: 5,384,343

[45] Date of Patent: * Jan. 24, 1995

[54] WATER ABSORBING POLYMERS

[75] Inventors: David Farrar; Peter Flesher; Malcolm Skinner; John Clarke; David Marshall, all of West Yorkshire, England

[73] Assignee: Allied Colloids Limited, England

[ * ] Notice: The portion of the term of this patent subsequent to Sep. 1, 2004 has been disclaimed.

[21] Appl. No.: 915,887

[22] Filed: Jul. 20, 1992

Related U.S. Application Data

[63] Continuation of Ser. No. 483,969, Feb. 15, 1990, abandoned, which is a continuation of Ser. No. 150,277, Jan. 29, 1988, abandoned, which is a continuation-in-part of Ser. No. 91,551, Aug. 31, 1987, Pat. No. 4,880,858, and a continuation-in-part of Ser. No. 835,602, Mar. 3, 1986, Pat. No. 4,690,971.

[30] Foreign Application Priority Data

| | | | |
|---|---|---|---|
| Jan. 30, 1987 | [GB] | United Kingdom | 8702052 |
| Jul. 20, 1987 | [GB] | United Kingdom | 8717093 |
| Aug. 13, 1987 | [GB] | United Kingdom | 8719215 |
| Aug. 13, 1987 | [GB] | United Kingdom | 8719216 |

[51] Int. Cl.[6] ..... C08K 11/00

[52] U.S. Cl. ..... 523/129; 524/59; 524/60; 524/68; 524/69; 524/413; 524/442; 524/444; 524/445; 524/446; 524/547; 524/555; 524/556

[58] Field of Search ..... 523/129; 524/59, 60, 524/69, 68, 413, 442, 444, 445, 446, 547, 555, 556

[56] References Cited

U.S. PATENT DOCUMENTS

| | | | |
|---|---|---|---|
| 3,991,005 | 11/1976 | Wallace | 523/129 |
| 4,059,552 | 11/1977 | Zweigle | 524/555 |
| 4,370,429 | 1/1983 | Clarke et al. | 524/60 |
| 4,542,176 | 9/1985 | Graham | 524/556 |
| 4,740,329 | 4/1988 | Wrench | 252/312 |
| 4,828,761 | 5/1989 | Mattus et al. | 523/129 X |
| 4,880,858 | 11/1989 | Farrar et al. | 524/60 |

FOREIGN PATENT DOCUMENTS

| | | | |
|---|---|---|---|
| 0045297 | 2/1982 | European Pat. Off. | 523/129 |

*Primary Examiner*—Judy M. Reddick

*Attorney, Agent, or Firm*—Venable, Baetjer, Howard & Civiletti

[57] ABSTRACT

A water absorbing particulate polymer material wherein the polymer material when in dry powder form has a particle size of about 50 μm to about 500 μm and wherein the particles consist of internally bonded finer particles which finer particles have a size below 50 μm. The process of using the water absorbing polymer, material to convert a wet sticky mass of inorganic particulate such as coal fines into a crumbly or flowable solid. A process using a water absorbing particulate polymer material to convert a wet sticky mass of organic particulate material into a crumbly or flowable solid wherein the organic matter can be, for example, food waste or sewage.

14 Claims, No Drawings

WATER ABSORBING POLYMERS

This application is a continuation of application Ser. No. 483,969, filed Feb. 15, 1990, now abandoned, which is a continuation-in-part application of Ser. No. 91,551, filed Aug. 31, 1987, now U.S. Pat. No. 4,880,858, and Ser. No. 835,602, filed Mar. 3, 1986, now U.S. Pat. No. 4,690,971, which is a continuation of application Ser. No. 150,277, filed Jan. 29, 1988, now abandoned.

It is well known to absorb aqueous fluids by means of water absorbent particulate polymeric material. In practice the material is always supplied for this purpose as a substantially dry powder that is sufficiently large as to avoid dusting problems. For instance its particle size is typically in the range 75 μm up to 3 mm.

The polymer can be semi-synthetic and it can be film forming, e.g., as in U.S. Pat. No. 3,935,099. Alternatively it can be wholly synthetic and non-film forming, as in EP 195550. In particular there is described in that specification a process in which a wet particulate mass which is not crumbly is converted to a crumbly state by mixing into the mass polymer particles that are substantially non-sticky when swollen with water and which are non-film forming and which are based on cross linked polyacrylic acid, optionally blended with acrylamide and other monomers. Although that specification mentioned the use of particles as small 10 μm it recommended values above 50 μm so as to avoid dusting problems, i.e., as is conventional.

We have also observed that, at any particular rate of addition, decreasing the particle size below the typical minimum of around 100 μm tends to make the crumbly mass less friable. This is probably because the smaller particle size results in a greatly increased number of particles. Although the particles are substantially non-sticky when several of the swollen polymer particles contact one another there can be a tendency for them to aggregate. The use of particles as low as 50 μm or less is therefore generally undesirable, but a tendency with the use of larger particles, e.g., 200 μm and above, is that their rate of absorption of liquid from the environment can be rather slow and, if such particles aggregate, then the aggregates are rather large and this can be undesirable.

According to the invention, a wet particulate sticky mass is converted to a crumbly or flowable solid by mixing into the mass water absorbent synthetic polymer particles that are substantially non-sticky when swollen with water and that are non-film forming, and in this process the particles have an effective dry size within the mass of at least 90% by weight below 50 μm and the particles are mixed into the mass while the particles are in the form either of internally bonded friable aggregates having a dry size of at least 90% by weight above 50 μm or in the form of a dispersion in water immiscible liquid of particles having a dry size of at least 90% by weight below 50 μm.

Thus in one aspect of the invention the polymer is introduced into the sticky mass in the form of a dispersion in water immiscible liquid of polymer particles having a dry size below 50 μm. It might have been thought that the incorporation of the water immiscible liquid would be undesirable but this does not seem to be the case and, instead, the liquid serves as a convenient vehicle for introducing the small particles in such a way as to avoid dusting and clustering of the individual particles within the mass. The particles can be mixed into the mass relatively easily so as to obtain uniform distribution of the particles, and they absorb water from the mass very rapidly.

In the second aspect of the invention the particles are introduced as dry powder having a particle size above 50 μm and which consists of internally bonded aggregates of finer particles having a size of below 50 μm and often below 30 μm. For instance polymer gel fines, e.g., as obtained from the comminution of polymer gel or as fines from a reverse phase bead polymerisation process, can be aggregated by swelling with sufficient water to form a comminutable gel, comminuted to a coarse size and dried (e.g., by a fluidised bed). These internally bonded aggregates appear to behave initially as coarse particles and then to behave as fines.

Any aqueous solution that permits swelling can be used. Water is usually best. An aqueous solution of a small amount of a soluble polymer or other binder could be used. The comminution can be to >90% by weight above 50 μm and usually above 100 μm, but generally below 1 or 2mm and often below 500 μm. Comminution can be by conventional gel comminution methods. Drying can be by conventional techniques followed if necessary by comminution in conventional manner. The resultant aggregates have a size in the range generally of 50 to 500 μm. They can very satisfactorily be used in the invention. The fines within each aggregate typically have a size mainly 5 to 30 μm and often below 20 μm.

By swelling the fines into a comminutable gel, the resultant dried comminuted particles appear to be internally bonded. This is in contrast to the skin bonding effect that is obtained if fines are merely sprayed with water and immediately dried in a fluid bed. Skin bonded aggregates can be used in the invention but internally bonded aggregates give better results. They are novel materials. By this means it is possible to achieve the rapid uptake of water and good friability at low doses that is obtained with the use of fine particles while avoiding the dusting problems and the risk of reduced friability at excess dosages that occurs with fine particles. Particularly good friability can be obtained, without risk of overdosing, using these aggregates. Preferably at least 90% by weight of the aggregates are above 125 μm.

The wet particulate sticky mass may be organic, for instance food waste or sewage, but is generally inorganic. It may be, for instance, sand, china clay, crushed mineral, red mud deposits, phosphate slime or coal. The process is of particular value when the particulate sticky mass is environmentally important, e.g., toxic or semi-liquid industrial waste, when it is economically important, e.g., carbon black or metallurgical suspension such as red mud or copper concentrates. The particulate material can be hydrophilic but is preferably hydrophobic.

The invention is of particular value when the sticky mass is a coal fines filter cake, for instance the sticky mass that results from vacuum filtration by a disc, drum or other vacuum filter of a slurry or froth flotation concentrate of coal fines, typically having a particle size below 0.5 mm. Often the particle size is mainly in range 50 to 300 μm, often at least 80% by weight below 100 μm. The ash content of the cake is usually below 30% often below 15%. The cake can be taken direct from the filter or it can be stored for prolonged periods, e.g., as a wet coal fine dump, before treatment in the invention.

The resultant mass is crumbly, as opposed to the sticky and pasty texture before treatment, and can easily be mixed with coal smalls to form a useful fuel, or used in some other way. Whereas 10% coal fines is often the maximum that can be incorporated by traditional techniques, in the invention the amount of coal fines can be increased considerably, e.g., to 20% or more. Typically the crumbly dry coal fines are used as an industrial fuel, e.g., in an electricity generating station. Often they are subjected to various treatments, such as blending, pelleting and/or grinding, before being burnt.

The coal fines filter cake or other wet particulate mass generally has a water content in the range 15 to 50%, often 20 to 40% and usually around 25 to 35%.

It is necessary to ensure uniform mixing of the polymer particles into the sticky mass. The mixing generally comprises some degree of back mixing and, in particular, plug mixing should be avoided since it will result in parts of the sticky mass remaining sticky, due to inadequate contact with polymer particles. The mixing can be achieved by tumbling the mass but preferably it is by means of a rotating mixing blade or other mixer that provides adequate shear. Preferably the mixing is by a Simon or other double scroll mixer or, preferably a plough share mixer, for instance a Lodige or Morton mixer. A plough share mixer has a substantially horizontal cylindrical container provided with a coaxial rotating shaft that carries a plurality of mixing shovels each generally having the shape of a plough share and mounted to rotate close to the wall of the cylinder. The peripheral speed and shape of the shovels causes the product to be whirled from the particulate mass in the lower part of the cylinder into the free mixing zone above the mass, so as to obtain high turbulence and both forward and back mixing.

The polymer must not become sufficiently sticky during the process to cause permanent aggregation of the particles that are being treated. The polymer preferably is wholly insoluble. If, as is preferred, the polymer is a synthetic polymer then the polymerisation conditions and the monomers are preferably such that the content of high molecular weight linear, or soluble, polymer is sufficiently low that during the process the particles do not become sticky.

The polymer may be natural or modified natural polymer such as a starch acrylonitrile graft copolymer or other modified starch, but preferably it is a synthetic polymer. It may be formed from a monomer blend such that the polymer, in linear form, is swellable but insoluble, for instance as a result of including hydrophobic monomer in the monomer blend. Such polymers can, for instance, be made by oil-in-water emulsion polymerisation. For instance they may be made at a pH at which they are relatively non-swellable and insoluble and the pH may then be adjusted, for use, to a value at which the particles are swellable and absorbent and that is the pH of the wet particulate mass.

Generally however the polymer is made from water soluble monomer or monomer blend. Suitable monomers are generally monoethylenically unsaturated monomers but cross linking agent is preferably included in order to convert the resultant polymer to water insoluble but water swellable form. The cross linking agent can be reacted into the polymer after polymerisation but preferably is present during polymerisation. Generally it is a di- or other poly- ethylenically unsaturated monomer such as methylene bis acrylamide or any of the other ethylenically unsaturated cross linking agents that are suitable for cross linking absorbent polymer particles. Instead of or in addition to relying on a covalent cross linking agent of this type, cross linking can also be through pendant groups in known manner. For instance it can be by polyvalent metal ions.

When the polymer particles are of cross linked, water swellable but insoluble, synthetic polymer, it is sometimes possible to achieve adequate results using a non-ionic polymer but best results are obtained more reliably using a cationic or anionic polymer. The polymer is made from the appropriate monomer or monomer blend. The monomers are generally acrylic. Preferably 5 to 100%, often 10 to 100% is ionic.

Suitable anionic monomers are ethylenically unsaturated carboxylic or sulphonic monomers such as (meth) acrylic acid, allyl sulphonate or 2-acrylamido methyl propane sulphonic acid. Anionic monomers are generally present as a water soluble salt, usually a sodium salt.

Suitable non-ionic monomers are (meth) acrylamide and (meth) acrylic esters.

Suitable cationic monomers are dialkyl amino alkyl (meth) -acrylate or -acrylamide as free base, acid salt or, preferably, quaternary salt and diallyl dimethyl ammonium chloride. Cationic monomers are generally used as a blend with acrylamide. Anionic monomers may be present as homopolymer or as copolymers of anionic monomer with, preferably, acrylamide.

The polymers can be as described in EP 213799, or cationic versions thereof.

In some instances best results are achieved using cationic polymer or blends of cationic polymer with anionic polymer, but it is often preferred to use anionic polymer alone. The preferred anionic polymers are cross linked polymers of 5 to 100 mole % acrylic acid (as free acid or salt) with 0 to 95 mole % acrylamide and optionally 0 to 50 mole % other non-ionic or anionic monomer. The acrylic acid is preferably present wholly or mainly, e.g., at least 70 or 80% by weight, as sodium acrylate. Suitable polymers are copolymers in which the amount of acrylic acid (as free acid or salt) is typically from 20 to 75% by weight, with the balance being acrylamide. It is generally preferred for least 40% by weight of the monomers for the anionic polymer to be sodium acrylate. Typical polymers of this general type are cross linked polymers of 40 to 60% by weight sodium acrylate with 60 to 40% by weight acrylamide when used as dispersions in water immiscible liquid.

Particularly preferred swellable polymers for use in the invention are sodium polyacrylate homopolymers, although up to 20% of the sodium acrylate can be replaced by acrylamide. Also some or all of the sodium acrylate groups can be replaced by acrylic acid or by other water soluble salts, generally alkali metal salts.

The degree of swellability and absorption is controlled, in part, by the extent of cross linking and the amount of cross linking agent is usually below 500 ppm, often below 300 ppm. It is usually at least 10 ppm or 20 ppm and preferably at least 50 ppm. Best results are often achieved at around 100 or 200 ppm. These amounts are the amounts by weight of monomer of methylene bis acrylamide and equivalent amounts of other cross linking agents may be used.

The degree of cross linking, and the polymer type, should be such that the gel capacity of the polymer (grams deionised water absorbed per gram polymer) is at least 25, generally at least 100 and preferably at least 200 typically up to 500 or even 700 or higher.

In some instances it is desirable for the polymer particles to have a surface layer that is less swellable than the inner parts of the particles. The desired reduced swellability of the surface layer is preferably obtained by cross linking the surface layer. This reduces the content of linear polymer at any position where it might cause stickiness and has the advantage of promoting uptake of water and of preventing aggregation of the polymer particles. The desired cross linking can be achieved by methods such as those described in U.S. Pat. No. 3,114,651, 3,251,814, 4,043,952, 4,093,013 and 4,090,013, JP 1983/42602 and EP 227305. Other ways of treating the surface are by applying a coating of a counter ionic polymer (e.g., poly diallyl dimethyl ammonium chloride or other cationic polymer when the swellable polymer is anionic) or by applying sodium aluminate or other aluminate.

The polymer particles may be introduced as individual particles having the size that is required during the mixing step or they may be introduced as aggregates that we assume break down during the mixing step into smaller particles.

When the particles are introduced into the mixing step in the form of a dispersion in water immiscible liquid, preferably at least 90% of the particles are below about 20 μm or 30 μm, and most preferably below 10 μm. Fastest results are generally achieved with at least 90%, preferably 99%, by weight being below 3 μm, e.g., in the range 0.03 to 2 μm. Often however adequate results are obtained in a cost effective manner, albeit more slowly, if the particle are 90% between 5 and 50 μm, e.g., about 5 to 30 μm.

Whereas most industrial processes that use dispersions of polymer in water-immiscible liquid require that the amount of polymer should be as high as possible, in the invention we find that best results are achieved when the amount of polymer is relatively low. Thus although the dry weight of polymer can be up to, for instance, 50 or 60% by weight of the dispersion, the dry weight of polymer in the dispersion is preferably below 45% by weight and preferably below 40%. Generally it is at least 15%, preferably at least 20%. Concentrations of 30 to 40% polymer dry weight based on total dispersion are often best when the polymer particles are wet and 20 to 30% when the polymer particles are dry.

The water-immiscible liquid may be any organic liquid in which the polymer particles can be adequately dispersed and that will not interfere with the process and so in practice needs to be substantially water immiscible. It can be, for instance, a vegetable oil but is preferably a hydrocarbon or halogenated hydrocarbon liquid. It may be selected from any of the liquids conventionally used in reverse phase dispersions. For instance it can be kerosene or diesel oil or other mineral oil.

The dispersion can be formed at the point of use, with the polymer particles being dispersed into the water-immiscible liquid and the mixture then being applied substantially immediately to the wet particulate mass. Preferably however the dispersion is preformed, in which event it needs to be substantially stable against settlement.

One form of dispersion is a suspension obtained by dispersing preformed dry polymer particles into water-immiscible liquid in the presence of a dispersion stabiliser. The preformed dry polymer particles can be reverse phase microbeads but preferably they are fines separated from polymer gel, e.g., obtained during the comminution of bulk or bead gel or separated from beads obtained by reverse phase polymerisation.

The amount of stabiliser is generally from 1 to 15%, often 3 to 10%, by weight based on the dry weight of polymer. Conventional stabilisers for oil based dispersions may be used, e.g., Bentone clays but preferably the dispersion is stabilised by stirring into it an aqueous emulsion of an oil soluble or oil swellable polymeric thickener, generally a thickener that is insoluble and non-swellable in water. Suitable thickeners are described in EP-A-0161926, for instance in Example 7 and at page 11 line 22 to page 12 line 10.

Instead of using polymer fines, typically having a size of 10 to 30 or 10 to 40 μm, the dispersion can be a reverse phase dispersion made by reverse phase polymerisation of aqueous monomer or monomer blend in water-immiscible liquid. See for instance U.S. Pat. No. 4,059,552. The reverse phase polymerisation is preferably conducted as a reverse phase suspension polymerisation. Formation of an initial dispersion of monomer particles can be facilitated by the incorporation of a small amount of water-in-oil emulsifying agent. Often amphipathic stabiliser is included, in known manner, especially when the dispersion is subsequently azeotroped. Depending upon the degree of agitation when forming the initial dispersion of aqueous monomer in the non-aqueous liquid, and depending upon the amount and type of stabiliser and emulsifier, if present, the dry particle size of the final dispersion can be controlled and typically has a maximum size of 1 μm or up to 2 or 3 μm or 10 μm at the most. The product of the reverse phase polymerisation can be described as an emulsion. It may be dried, e.g., by azeotroping to reduce the water content, typically to below 15% by weight of the polymer. The product is then a substantially dry dispersion.

The amount of amphipathic stabiliser (if present) is generally in the range 0.2 or 0.5 to 10%, and generally below 5%, based on the weight of polymer. The amount of water-in-oil emulsifier is preferably from 0.2 to 3%, based on weight of monomer.

In normal processes in which a reverse phase dispersion in oil of water soluble or swellable polymer is mixed into water, it is conventional to conduct the mixing in the presence of an oil-in-water emulsifier so as to promote distribution of the dispersion and the dispersed polymer into the water. For instance, it is common to add the emulsifier to the polymer dispersion before blending with the water. Because of the apparent need to achieve rapid distribution of the polymer throughout the wet particulate mass, we therefore expected it to be necessary to use such an emulsifier. We have surprisingly found, in the invention, that better results are achieved in the absence of this emulsifier than when the conventional addition is made. This suggests, surprisingly, that it is desirable to retard the rate at which the polymer particles are made available to, and can take up water from, the wet particulate mass.

Since one purpose of the polymer particles is to absorb water from the wet particulate mass it would be expected that the particles should be as dry as possible at the start of the process. However we have surprisingly found that improved results are achieved when, at the time of addition to the wet particulate mass, the polymer particles in the dispersion contain a substantial amount of water, usually at least 30% based on the dry weight of polymer. Usually the amount is below 150% and typically is in the range 60 to 120%, preferably 80 to 100%, based on the dry weight of polymer.

Preferred compositions comprise 20 to 50% by weight of each of the polymer (dry weight), water-immiscible liquid and water. The amount of each of the polymer and the water immiscible liquid is preferably 25 to 45%, most preferably 30 to 40% by weight. The amount of the water is preferably from 20 to 40%, most preferably 25 to 35%. Particularly preferred compositions comprise 30 to 40% by weight polymer, 30 to 40% by weight water immiscible liquid and 25 to 35% by weight water, with the amount of water generally being less than the weight of polymer.

Compositions containing such amounts of water tend to be unstable if the dry particle size is significantly above 10 μm and so the preferred compositions that contain water have a particle size lower than this, preferably below 3 μm. They can be made by reverse phase polymerisation (usually by reverse phase suspension polymerisation) to form an emulsion of aqueous polymer gel particles dispersed in the water immiscible liquid, and then the emulsion can be used as such without further drying and without the addition of oil-in-water activator. However for some purposes it appears best to dry the emulsion by azeotroping in conventional manner and then to add water back into the dispersion.

It is very surprising that better results can be achieved using wet polymer particles than dry, both because it would be expected that dry particles would be more effective absorbents and because it has occasionally been suggested in the literature that wet particles initiate absorption quicker than dry particles. However the improved results obtainable in the absence of oil-in-water emulsifier indicate that accelerated absorption is not desirable.

When the polymer particles are large, such that the swollen polymer particles have a size greater than the size of most or all of the particles being treated, the swollen polymer particles can subsequently be separated from the dry treated particles. For instance in one process according to the invention at least 50% (dry weight) of the swollen polymer particles have a size greater than the size of at least 95% of the substantially dry treated particles, and these oversize swollen particles are separated from the dry treated particles. Preferably the polymer particles swell to at least twice their dry diameter and substantially all the said swollen polymer particles have a size greater than the size of substantially all the dry treated particles and the polymer particles are separated from the dry treated particles. The separation may be by conventional size classification or weight classification techniques, preferably by seiving using a vibrating seive.

When the particles being treated are coal fines, the resultant friable mass is subsequently used as fuel and as a result of having separated the polymer from the fines the water content of the polymer is not carried in to the fuel and the separated swollen particles can, if desired, be dried (e.g., by heat exchange from the fuel burner) and can be recycled for further use.

The swellable polymer particles may be mixed with the wet particulate mass without any prior addition of any material to the particulate mass. However improved results can be achieved if the particulate mass that is mixed with the swellable polymer particles has previously been treated with a co-ionic dispersing agent, a counter-ionic coagulant, or a co-ionic, counter-ionic or non-ionic flocculant. For instance the mass may be blended with a solution of the dispersing agent, coagulant or flocculant so as to promote liberation of bound water from the cake, before adding the absorbent polymer particles. In some instances it can be desirable to include the dissolved agent with the mass at the time of a filtration stage, e.g., for producing the mass as a wet filter cake. For instance a slurry or froth concentrate of coal fines can be treated by a coagulant or a flocculant or a combination (usually a coagulant followed by a flocculant) prior to filtration to provide the wet filter cake.

Co-ionic dispersing agent is generally a polymer of low molecular weight, usually below 500,000, generally below 200,000 and often below 50,000. For many processes molecular weights of below 10,000, e.g., 2,000 to 5,000, are satisfactory. The dispersing agent is usually anionic. The counter-ionic coagulant generally has a molecular weight of above 50,000, often in the range 100,000 to 1 million, typically about 500,000. However it can have a higher molecular weight. The flocculant can have molecular weight below 1 million but generally it is above. It can be of several million, and can be of typical flocculant molecular weight.

Although these polymeric agents are usually substantially linear and in true solution, it can be particularly advantageous, when the agent is a higher molecular weight agent such as a flocculant, for it to be in the form of very small particles at the time it is mixed with the wet mass, preferably being a slightly cross linked polymer, as describes in EP 0202780.

The added agents are usually synthetic polymers formed from water soluble ethylenically unsaturated monomers, and these monomers will be chosen to give the polymer the desired ionic characteristic. Generally the agents are formed wholly from ionic monomers or from blends of ionic monomers with acrylamide or other non-ionic monomers, such as (meth) acrylic esters.

The anionic monomer is preferably acrylic acid but can be any other suitable ethylenically unsaturated monocarboxylic acid or sulphonic acid. It can include or consist of 2-acrylamido-2-methyl propane sulphonic acid. The anionic monomer is generally present as a water soluble salt, generally the sodium salt.

Suitable cationic monomers include diallyl dimethyl ammonium chloride and dialkyl amino alkyl (meth) -acrylates or -acrylamides, generally as acid addition or quaternary ammonium salts. For instance the cationic dispersing agent is preferably a low molecular weight polymer of diallyl dimethyl ammonium chloride or dimethyl amino ethyl (meth) acrylate, or a blend of either of these with acrylamide.

When a dispersant or coagulant or other material is being incorporated before the absorbent polymer, it is generally applied as a solution but can be applied in solid form if its solubility is such as to permit it to dissolve relatively rapidly within the wet filter cake.

It is often preferred that the particle sizes and the amounts of the absorbent polymer and of the filter cake are such that the number ratio of polymer particles:filter cake particles is approximately 1, e.g., from 3:1 to 1:3. For instance this is achieved by adding about 0.2% (dry on dry) of polymer particles having a particle size of about 20 to 30 μm to filter cake having a particle size of about 100 μm. Larger amounts of these polymer particles are appropriate when the filter cake has a significant electrolyte content.

The amount of polymer that is applied is generally at least 0.005% and is preferably at least 0.05%. It is usually below 5%, preferably below 1% and most preferably is around 0.05 to 0.5%. It is a particular advantage of the invention that, despite the unpleasant character of the wet mass, good results can be obtained with very low amounts of polymer, often below 0.3% or 0.4% and often below 0.15% or 0.2%. These amounts are of dry polymer based on dry particles by weight.

The following are some examples. The coal filter cakes used in these examples have a maximum particle size below 0.5 mm and contain generally 20 to 30% water and 10 to 15% ash. In the examples values are named as the "shear dissociation time" and the "dissociation time".

The "dissociation time" is recorded by putting 600 g of the coal filter cake in a Hobart mixer bowl, adding the water absorbent polymer, and stirring at speed 2 until the product became sufficiently friable that aggregates start being thrown out of the bowl. The time take for this stage to be reached is the dissociation time and should be as low as possible.

After stirring for a further 2 minutes at speed 1, the resultant mix is left for 30 minutes in a sealed bag. 100 grams of the mix is put into a cylinder 65 mm in diameter and pressed into this cylinder to a disc under a cake-forming pressure of 0.38 kg/cm$^2$ (5.5 psi) to give a cake. The cake is placed on a rectangular plate so that the entire cake is within the profile of the plate, but a substantially semicircular portion is cut away from one side of the plate so that about one third of the cake is unsupported. A solid plate is lowered at 12 mm/sec on to the top of the cake by a piston and is pressed down on to it with a pressure of 5 psi (0.35 kg/cm$^2$). The time is measured between the plate touching the top of the cake and the cake shattering over the cut away part of the test plate. This is the shear dissociation time (SDT 5). If the cake shatters immediately upon contact with the lowering plate, the shear dissociation time is recorded as zero. Again, low values are preferred. The test can be repeated at higher cake-forming pressures of 20 and 50 psi to give SDT 20 and SDT 50 values.

SDT 5 needs to be below 30 seconds for generally satisfactory results and, in particular, if SDT 5 is below about 20 seconds, preferably below about 10 seconds and most preferably below about 7 seconds (especially substantially zero) and if the dissociation time is satisfactory, then the polymer cake combination is such that, with appropriate mixing, homogeneous blendability with coal smalls can be expected. For instance Examples 1 and 2 below show that good results are obtained when SDT 5 is not above 7 and dissociation is not above 18.

For the friable cake to resist caking or clogging during transport, a more friable texture is needed. For this, the SDT test is repeated under a cake-forming pressure of about 20 psi (1.4 kg/cm$^2$), to determine SDT 20, or even at about 50 psi (3.5 kg/cm$^2$) to determine SDT 50. These values also should be below about 20, preferably below about 10, most preferably below about 7 seconds, especially substantially zero.

Example 1

Sodium polyacrylate cross linked with 0.025% methylene bis acrylamide is formed by conventional bulk gel polymerisation and is dried and comminuted in conventional manner. The resultant particles are classified according to size and the fines are retained for use in the invention. They have a dry particle size below 50 μm, mainly in the range 10 to 30 μm.

The fines are dispersed into an equal weight of a hydrocarbon oil that is thickened with a dispersion stabiliser as described at page 18 lines 25 to 35 of EP 0161926A. 1% oil-in-water emulsifier is included.

The dispersion is sprayed on to a wet filter cake of coal fines, this filter cake having been taken from a vacuum filter following froth flotation. The amount of dispersion is 0.1% dry polymer on dry particulate mass. The product is mixed thoroughly and rapidly became a friable, crumbly solid. This can easily be blended with coal smalls to form a fuel. Without the addition of the dispersion, the filter cake is a wet sticky mass that could not easily be used.

In a comparison, when a similar amount of dry polymer particles of the same polymer but having a size of around 100 μm, and that are not dispersed in oil, was added to the cake, the cake does not become so crumbly so quickly. With prolonged mixing and larger amounts of polymer (.e.g, 0.2% or even 0.5%) the product is adequately crumbly but swollen polymer particles and aggregates are apparent.

Example 2

Three types of dispersion, each containing equal amounts of polymer and hydrocarbon oil (kerosene or diesel), and oil-in-water emulsifier, are made as follows.

Suspensions—by the general technique of Example 1 using particles of the size shown, with >90% by weight <50 μm when the suspension is shown as <65 μm RP Emulsions—by the reverse phase polymerisation to give a product of about 35% oil, 35% polymer, 30% water RP Dispersions—by azeotroping RP Emulsions to about 50% polymer 50% oil The compositions are tested at 0.5% product on wet coal filter cake as above. The monomers used and the results are in the following table, where NaAc=% sodium acrylate, ACM=% acrylamide and MBA=-methylene bis acrylamide (ppm).

| Composition | NaAc | ACM | MBA | Dis-sociation | SDT 5 |
|---|---|---|---|---|---|
| Ex 1 | 100 | 0 | 200 | 18 | 7 |
| 355–500 μm Suspension | 50 | 50 | 200 | 82 | 0 |
| 65–180 μm Suspension | 50 | 50 | 200 | 28 | 0 |
| <65 μm Suspension | 50 | 50 | 200 | 14 | 0 |
| RP Dispersion | 50 | 50 | 100 | 50 | 0 |
| " | 50 | 50 | 200 | 37 | 0 |
| " | 50 | 50 | 300 | 75 | 0 |
| " | 25 | 75 | 25 | 30 | +30 |
| " | 25 | 75 | 50 | 42 | 11 |
| " | 25 | 75 | 100 | 32 | 0 |
| " | 25 | 75 | 200 | 40 | 0 |
| RP Emulsion | 100 | 0 | 100 | 31 | 4.2 |
| RP Dispersion | 100 | 0 | 100 | 25 | 14 |

It is apparent from this that the overall trend is that better results are obtained when the size is below 50 μm. The disadvantage of too little cross-linking agent, for the particular mass, is apparent. This is probably due to the polymer containing too much soluble polymer.

Example 3

Tests similar to Example 2 are conducted on RP dispersions of 50% oil and 50% of a copolymer of 50% NaAc 50% ACM 200 ppm MBA with or without added oil-in-water emulsifier, at different amounts of polymer.

| Dispersion Amount | Emulsifier | Dissociation | SDT 5 |
|---|---|---|---|
| 0.5% | 0 | 16 | 0 |
| 0.2% | 0 | 25 | 1.8 |
| 0.5% | 3% | 23 | 0 |
| 0.2% | 3% | 37 | 2.2 |

The disadvantage of incorporating emulsifier is apparent.

Example 4

Tests similar to Example 2 are conducted on a 50% RP dispersion of a copolymer of 50% NaAc 50% ACM 200 ppm MBA (product A) and the same product after dilution to 25% polymer by red diesel oil (B).

| Dispersion Amount | Polymer Concentration | Dissociation | SDT 5 |
|---|---|---|---|
| 0.5% A | 50% | 19.4 | 2.6 |
| 0.3% A | 50% | 30.1 | 11.0 |
| 1.0% B | 25% | 14.8 | 2.3 |
| 0.6% B | 25% | 22.3 | 7.9 |

The benefit of reducing the polymer concentration is apparent.

Example 5

A RP dispersion is formed of 50% oil 50% copolymer of 50% NaAc 50% ACM 200 ppm MBA. This is diluted with various amounts of water and the products are tested on wet coal filter cake as in Example 2 at different dosages of product.

| Product Amount | Polymer % | Water % | Oil % | Dissociation | SDT 5 |
|---|---|---|---|---|---|
| 0.5% | 50 | 0 | 50 | 19 | 3.4 |
| 0.2% | 50 | 0 | 50 | 31 | 30 |
| 0.56% | 45 | 10 | 45 | 31 | 4.8 |
| 0.22% | 45 | 10 | 45 | 34.6 | 10.6 |
| 0.63% | 40 | 20 | 40 | 24.9 | 3.8 |
| 0.25% | 40 | 20 | 40 | 31.8 | 8.9 |
| 0.71% | 35 | 30 | 35 | 24.1 | 2.4 |
| 0.29% | 35 | 30 | 35 | 29.9 | 14.4 |
| 0.83% | 30 | 40 | 30 | 22.5 | 2.9 |
| 0.33% | 30 | 40 | 30 | 26.8 | +30 |
| 1.0% | 25 | 50 | 25 | 22.6 | 3.9 |
| 0.4% | 25 | 50 | 25 | 29.7 | +30 |

This clearly shows that the addition of a controlled amount of water gives improved results at low dosages and thus provides a particularly cost effective system.

Example 6

Example 2 is repeated using similar amounts of three different polymer suspensions. ACN is acrylonitrile.

Tests 5, 6 and 7 were conducted with different starch acrylonitrile copolymers dispersions. Tests 8–10 are with 60% dispersions in oil and tests 11 to 13 are with 50% dispersions in oil. Test 14 is with 1% of a 25% emulsion of aqueous polymer particles in oil and test 15 with a 50% dry dispersion of similar, but dry, polymer particles.

| Test | Polymer | ppm MBA | Amount | Dissociation | SDT 5 |
|---|---|---|---|---|---|
| 1 | 100 NaAc | 200 | 0.5% | 18 | 4.6 |

-continued

| Test | Polymer | ppm MBA | Amount | Dissociation | SDT 5 |
|---|---|---|---|---|---|
| 2 | Superabsorbent Starch | — | 0.25% | 22.3 | 8.3 |
| 3 | 30 Starch 70 ACN | — | 0.25% | +120 | +30 |
| 4 | 30 Starch 70 ACN | — | 0.75% | 33.5 | 3 |
| 5 | 15 Starch 85 ACN | — | 0.4% | 20.9 | 4.2 |
| 6 | 15 Starch 85 ACN | — | 0.4% | 83.7 | 0.0 |
| 7 | 15 Starch 85 ACN | — | 0.4% | 23.3 | 30 |
| 8 | 25 NaAc 75 ACM | 100 | 0.4% | 20.3 | 3.4 |
| 9 | 20 NaAc 80 ACM | 100 | 0.4% | 25.6 | 2.6 |
| 10 | 10 NaAc 90 ACM | 100 | 0.4% | 29.8 | 2.4 |
| 11 | 50 NaAc 50 ACM | 200 | 0.5% | 37.6 | 0 |
| 12 | 25 NaAc 75 ACM | 200 | 0.5% | 40.5 | 0 |
| 13 | 100 ACM | 200 | 0.5% | 39.4 | +30 |
| 14 | 50 NaAc 50 ACM | 100 | 1% | 23.0 | 3.9 |
| 15 | 50 NaAc 50 ACM | 100 | 0.5% | 22.4 | 2.9 |

Example 8

The process of example 2 is repeated but using a 35% by weight RP emulsion in oil of cationic swellable polymer formed from 60% ACM 40% dimethylaminoethyl acrylate (MeCl quaternary salt). At 1% dosage, Dissociation is 11.7 seconds and SDT 5 is 0.9. When using a 1% polymer dosage of a 50% RP dispersion of a swellable polymer of 50% ACM 50% NaAc (instead of the cationic polymer). Dissociation is 11 and SDT 5 is 1.2.

Example 9

An aqueous solution of cationic soluble polymer A, B or C is stirred into a wet filter cake of coal fines. After stirring for one minute, a 50% dispersion in oil of cross linked gel polymer particles of acrylamide and sodium acrylate polymer is blended into the filter cake. The results are as follows, in which polymer A is a low molecular weight diallyl dimethyl ammonium chloride coagulant, polymer B is a high molecular weight, slightly cross linked, copolymer of 58 mole percent acrylamide and 42 mole percent cationic dialkylaminoalkyl acrylate quaternary monomer, and polymer C is a homopolymer of a cationic dialkylaminoalkyl methacrylate quaternary monomer. In addition to the results shown in the table below, the product was assessed visually and it was significant that increasing amounts of product B, and especially the tests with product C, gave the best visual appearance.

| % Cationic Polymer | % Dispersion | Dissociation | SDT |
|---|---|---|---|
| — | 0.5 | 18.4 | 6.7 |
| 0.05 A | 0.5 | 19.6 | 3.1 |
| 0.15 A | 0.5 | 17.5 | 3.6 |
| — | 1.0 | 17.5 | 2.6 |
| 0.15 A | 1.0 | 16.9 | 0 |
| 0.3 A | 1.0 | 15.2 | 1.9 |
| — | 1.0 | 17.5 | 2.6 |
| 0.08 B | 1.0 | 12.1 | 2.0 |
| 0.16 B | 1.0 | 10.9 | 0 |
| — | 1.0 | 17.5 | 2.6 |
| 0.4 C | 1.0 | 8.7 | 0 |
| 0.8 C | 1.0 | 8.6 | 0 |

Example 10

Fines having a size mainly 10–30 μm are separated from comminuted cross linked polyacrylic acid (75% as sodium salt) gel having a gel capacity well in excess of 25 g/g. They are labelled A. Part of them are mixed with sufficient water to make a comminutable gel which is then comminuted and dried on a fluid bed drier, in conventional manner, to a particle size >125 μm but below 500 μm. This is labelled B. Each product is mixed with coal filter cake as in Example 1 at various doses.

| Product | Product Dose (1%) | Dissociation Time (sec) | SDT 5 | SDT 20 | SDT 50 |
|---|---|---|---|---|---|
| A | 0.25 | 13.1 | 2.7 | 30+ | 30+ |
| | 0.5 | 9.9 | 1.3 | 4.7 | 30+ |
| | 0.75 | 8.3 | 0.7 | 2.9 | 30+ |
| | 1.0 | 7.9 | 0.9 | 2.9 | 30+ |
| B | 0.25 | 23.2 | 1.5 | 30+ | |
| | 0.5 | 14.8 | 0 | 2.0 | 30+ |
| | 0.75 | 13.1 | 0 | 0 | 3.6 |
| | 1.0 | 12.5 | 0 | 0 | 2.1 |

This demonstrates that the agglomerates give improved results at higher dosages but give similar results at lower dosages.

As a comparison products A, B and C are formed from 50% ACM 50% NaAc cross linked swellable polymer having gel capacity above 25 g/g. A is a dispersion in oil of particles <40 μm. B is powder <63 μm and C >125 μm. Different amounts are blended as in Example 1. The results are as follows.

| Product | Active Dose (1%) | Dissociation Time (sec) | SDT 5 | SDT 20 | SDT 50 |
|---|---|---|---|---|---|
| A <40 μm | 0.15 | 15.6 | 2.7 | 30+ | |
| | 0.25 | 12.5 | 1.7 | 30+ | |
| | 0.5 | 9.8 | 2.5 | 30+ | |
| | 0.75 | 8.1 | 2.4 | 30+ | |
| | 1.0 | 7.4 | 2.7 | 30+ | |
| | 2.0 | 5.9 | 2.5 | 30+ | |
| B <63 μm | 0.15 | 20.8 | 30+ | | |
| | 0.25 | 12.2 | 2.7 | 30+ | |
| | 0.5 | 8.9 | 1.2 | 3.1 | 30+ |
| | 0.75 | 8.2 | 0 | 3.5 | 30+ |
| | 1.0 | 7.2 | 0 | 3.8 | 30+ |
| | 2.0 | 6.6 | 0 | 3.9 | 30+ |
| C >125 μm | 0.15 | 25.4 | 30+ | | |
| | 0.25 | 15.7 | 1.0 | 5.6 | 30+ |
| | 0.5 | 10.9 | 0 | 0 | 2.0 |
| | 0.75 | 9.5 | 0 | 0 | 0.8 |
| | 1.0 | 9.3 | 0 | 0 | 0.8 |
| | 2.0 | 7.5 | 0 | 0 | 0 |

Example 11

Polyacrylic acid (about 75% in sodium form) gel cross linked with about 200 ppm MBA is formed, comminuted and dried in conventional manner. Fines having a size mainly in the range 10 to 40 μm are separated and dispersed at 50% solids in kerosene or diesel using an emulsion of stabilising polymer (as in EP-A-0161926, Example 7) as stabiliser.

The resultant dispersion is diluted to about 25% solids with further kerosene or diesel and sprayed at about 0.2% polymer on to coal filter cake having a coal size mainly 50 to 150 μm and a moisture content around 30% and an ash content of around 10% as the cake is fed into a continuously moving Lodige Plough Share mixer.

The mix passes through the mixer in not more than about 2 minutes and emerges as a friable product that can easily be crumbled between the fingers (the SDT 5 for the wet filter cake-polymer combination is below 10).

The friable product is blended with about 5 times its own weight of coal smalls having a size of 1 to 10 mm and the mix is pulverised and carried, entrained in air from the pulverisers, as a fuel into the combustion chamber of a power station boiler. There is no evidence of clogging of the pulverisers or other parts of the apparatus through which the product travels from the mixer to the boiler.

The blend, before pulverisation, may flow evenly out of a Durham Cone at that is uniform and is about 1.4 kg/sec, whereas the untreated cake clogs or flows unevenly at about half that rate.

Example 12

A wet cake of particulate magnetite having 14.6% moisture content is blended with a dispersion in oil of swellable, cross-linked polymer fines having a particle size below 40 μm. The amount of dispersion is 0.25% by weight polymer based on wet magnetite. When the polymer is formed from 50% ACM 50% NaAc, dissociation time=7 seconds, SDT 5=0 and SDT 20>30. When the polymer is formed of neutralised polyacrylic acid, dissociation time=8.2 seconds, SDT 5=5.7 and SDT 20>30.

We claim:

1. A process in which a wet sticky mass of particulate material selected from organic material and inorganic material is converted to a crumbly or flowable solid by mixing into the mass of particulate material, water absorbent polymer particles that are selected from starch acrylonitrile graft copolymers and polymers formed by polymerization of water soluble ethylenically unsaturated monomer or monomer blend, and in which the polymer particles have an effective dry size within the mixture of at least 90% below 50 μm and are mixed into the mass of particulate material while the particle are in the form either of a dry powder having a particle size above 50 μm and which consists of internally bonded friable aggregates of finer particles below 50 μm in size, or of a dispersion of particles below 50 μm in size in water immiscible liquid.

2. The process of claim 1 wherein said particulate material is organic material selected from the group consisting of food waste and sewage.

3. The process of claim 1 in which the polymer particles are mixed into the said mass while the particles are in the form of aggregates which have a size from 50 μm to about 500 μm.

4. The process of claim 3 wherein said finer particles have a size from about 5 μm to about 30 μm.

5. The process of claim 3 wherein at least 90 percent by weight of said polymer aggregates have a size above 125 μm.

6. The process of claim 1 wherein the particulate material of said sticky mass is inorganic material.

7. The process of claim 6 wherein said inorganic material is selected from the group consisting of carbon black, metallurgical suspension material of red mud, metallurgical suspension material of copper concentrates, crushed mineral and coal.

8. The process according to claim 1 wherein the wet sticky mass of particulate material is mixed with a flocculant or with a counter-ionic coagulant before addition of the water absorbant polymer.

9. The process according to claim 1 wherein the absorbent polymer is a polymer of 5 to 100 mole % acrylic acid as free acid or water soluble salt, 0 to 95 mole % acrylamide, 0 to 50 mole % other monoethylenically unsaturated monomers and cross linking agent in an amount of at least 50 ppm but below 500 ppm.

10. A process according to claim 1 wherein the water absorbant polymer is formed from monomers selected from the class consisting of anionic monomers selected from the group consisting of methacrylic acid, acrylic acid, allyl sulfonate, 2-acrylamido methyl propane sulfonic acid, and water soluble salts thereof, non-ionic monomers selected from the group consisting of methacrylamides, acrylamide, methacrylic esters and acrylic esters, and cationic monomers selected from the group consisting of dialkylaminoalkyl acrylates, dialkylaminoalkyl methacrylates, dialkylaminoalkyl acrylamides, dialkylaminoalkyl methacrylamides, acid salts thereof and quaternary salts thereof.

11. The process of claim 1 in which the polymer particles are mixed into the said mass while the particles are in the form of a dispersion in water immiscible liquid of polymer particles of which at least 90% by weight are below 30 μm in size.

12. The process of claim 1 in which the said sticky mass is coal fines filter cake.

13. The process of claim 9 in which the absorbent polymer is formed from 40 to 100% by weight sodium acrylate and 0 to 60% by weight acrylamide together with the cross linking agent.

14. A process of pelleting coal fines which comprises converting a wet sticky mass of coal fines to a crumbly or flowable solid and then pelleting said solid, the process of converting said mass of coal fines to said solid comprising mixing into the wet sticky mass of coal fines water absorbent polymer particles that are selected from starch acrylonitrile graft copolymers and polymers formed by polymerization of water soluble ethylenically unsaturated monomer or monomer blend, and in which the polymer particles have an effective dry size within the mixture of at least 90% below 50 μm and are mixed into the mass of particulate material while the particles are in the form either of a dry powder having a particle size above 50 μm and which consists of internally bonded friable aggregates of finer particles below 50 μm in size, or of a dispersion of particles below 50 μm in size in water immiscible liquid.

* * * * *